US009701326B2

(12) United States Patent
Kull

(10) Patent No.: US 9,701,326 B2
(45) Date of Patent: Jul. 11, 2017

(54) BROKEN RAIL DETECTION SYSTEM FOR RAILWAY SYSTEMS

(71) Applicant: Westinghouse Air Brake Technologies Corporation, Wilmerding, PA (US)

(72) Inventor: Robert C. Kull, Olney, MD (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 356 days.

(21) Appl. No.: 14/484,672

(22) Filed: Sep. 12, 2014

(65) Prior Publication Data

US 2016/0075356 A1 Mar. 17, 2016

(51) Int. Cl.

| | |
|---|---|
| ***B61L 23/00*** | (2006.01) |
| ***B61L 23/04*** | (2006.01) |
| *B61L 1/18* | (2006.01) |

(52) U.S. Cl.

CPC ..... *B61L 23/044* (2013.01); *B61L 1/188* (2013.01)

(58) Field of Classification Search

CPC ..... B61L 23/04; B61L 23/042; B61L 23/044; B61L 23/047; B61L 23/048; B61L 1/18; B61L 1/188

See application file for complete search history.

(56) References Cited

U.S. PATENT DOCUMENTS 4,306,694 A 12/1981 Kuhn
4,728,063 A 3/1988 Petit et al.
4,886,226 A * 12/1989 Frielinghaus ..... B61L 23/041 246/121
4,979,392 A * 12/1990 Guinon ..... B61L 23/044 246/121
5,145,131 A 9/1992 Franke
5,263,670 A * 11/1993 Colbaugh ..... B61L 3/246 246/167 R (Continued)

FOREIGN PATENT DOCUMENTS

WO 2014026086 A2 2/2014
WO 2014027977 A1 2/2014
WO 2014163864 A1 10/2014

OTHER PUBLICATIONS

Sullivan, "CBTC Radios—What to Do? Which Way to Go?", Draft Version of Article published in 2005 C&S Buyer's Guide, Railway Age, six pages.

(Continued)

*Primary Examiner* — Jason C Smith
(74) *Attorney, Agent, or Firm* — The Webb Law Firm

(57) ABSTRACT

A broken rail detection system including: a power module having: a first electrical connection to the first rail to apply a direct current voltage; and a second electrical connection to the second rail to apply a direct current voltage; a diode shunt arrangement; a measurement device to sense or measure current; and a controller programmed or configured to: (i) cause at least one application of a direct current voltage of a first polarity on the railway track; (ii) determine the current resulting from the application step (i); (iii) cause at least one application of a direct current voltage of a second polarity on the railway track; (iv) determine the current resulting from the application step (iii); and (v) determine the presence or absence of a break based at least partially on the determined current.

25 Claims, 1 Drawing Sheet

(56) References Cited

U.S. PATENT DOCUMENTS 5,398,894 A * 3/1995 Pascoe ..... B61L 21/10 246/122 R
5,470,034 A 11/1995 Reeves
5,533,695 A * 7/1996 Heggestad ..... B61L 27/0038 246/1 R
5,680,054 A * 10/1997 Gauthier ..... B61L 23/044 246/121
5,804,731 A 9/1998 Jaeggi
5,978,718 A 11/1999 Kull
5,995,881 A 11/1999 Kull
6,102,340 A * 8/2000 Peek ..... B61L 23/044 246/121
6,119,353 A * 9/2000 Grçnskov ..... E01B 35/12 33/1 Q
6,262,573 B1 * 7/2001 Wojnarowski ..... B61K 9/10 324/217
6,424,150 B2 * 7/2002 Kwun ..... 324/216
6,549,005 B1 * 4/2003 Hay ..... G01N 27/82 324/217
6,655,639 B2 12/2003 Grappone
6,779,761 B2 * 8/2004 Holgate ..... B61L 23/044 246/122 R
6,845,953 B2 * 1/2005 Kane ..... B61L 3/125 246/167 R
6,848,658 B2 2/2005 McAllister
6,863,246 B2 * 3/2005 Kane ..... B61L 1/20 246/121
6,895,362 B2 * 5/2005 Davenport ..... B61L 23/041 246/120
6,951,132 B2 10/2005 Davenport et al.
6,957,131 B2 * 10/2005 Kane ..... B61L 3/12 701/19
6,996,461 B2 * 2/2006 Kane ..... B61L 3/004 116/36
7,017,864 B2 * 3/2006 McAllister ..... B61L 1/188 246/34 R
7,036,774 B2 5/2006 Kane et al.
7,219,067 B1 * 5/2007 McMullen ..... B61L 27/0011 246/122 R
7,226,021 B1 * 6/2007 Anderson ..... B61L 23/044 246/120
7,268,565 B2 * 9/2007 Anderson ..... B61L 23/044 246/121
7,403,296 B2 * 7/2008 Farritor ..... G01N 3/48 356/614
7,467,032 B2 * 12/2008 Kane ..... B61L 15/0027 104/307
7,616,329 B2 * 11/2009 Villar ..... B61K 9/08 356/625
7,755,660 B2 * 7/2010 Nejikovsky ..... B61K 9/08 348/135
7,755,774 B2 7/2010 Farritor et al.
7,823,841 B2 * 11/2010 Anderson ..... B61L 23/044 246/121
7,920,984 B2 * 4/2011 Farritor ..... B61K 9/08 356/614
7,937,246 B2 * 5/2011 Farritor ..... B61K 9/08 356/614
7,954,770 B2 * 6/2011 Tomlinson, Jr. ..... B61L 23/044 246/121
7,999,848 B2 * 8/2011 Chew ..... B61K 9/08 348/143
8,332,147 B2 * 12/2012 Robinson ..... E01B 35/12 701/470
8,577,647 B2 11/2013 Farritor et al.
8,905,359 B2 12/2014 Li et al.
8,914,162 B2 12/2014 Kernwein et al.
2001/0019263 A1 9/2001 Kwun et al.
2002/0113170 A1 * 8/2002 Grappone ..... B61L 23/044 246/120
2003/0112131 A1 6/2003 McAllister
2005/0061923 A1 3/2005 Kane et al.
2005/0076716 A1 * 4/2005 Turner ..... B61L 23/041 73/579
2006/0017911 A1 1/2006 Villar et al.
2008/0105791 A1 * 5/2008 Karg ..... B61K 9/10 246/120
2010/0204857 A1 * 8/2010 Forrest ..... B61L 27/0094 701/19
2012/0300060 A1 * 11/2012 Farritor ..... B61K 9/08 348/125
2013/0284859 A1 * 10/2013 Polivka ..... B61L 27/0055 246/34 R
2014/0041980 A1 2/2014 Noffsinger et al.
2014/0125356 A1 5/2014 Cooper et al.
2014/0129154 A1 * 5/2014 Cooper ..... B61L 3/121 702/34
2014/0138493 A1 * 5/2014 Noffsinger ..... B61L 3/10 246/121
2014/0152814 A1 * 6/2014 Farritor ..... B61K 9/08 348/142
2014/0180609 A1 * 6/2014 Berggren ..... G01C 7/04 702/42
2014/0207317 A1 * 7/2014 Noffsinger ..... B61K 9/10 701/19
2014/0238139 A1 8/2014 Loveday
2015/0051792 A1 2/2015 Kristen et al.
2015/0291192 A1 10/2015 Li et al.
2016/0075356 A1 * 3/2016 Kull ..... B61L 23/044 246/121
2016/0107664 A1 * 4/2016 Kull ..... B61L 23/044 246/121

OTHER PUBLICATIONS

Turner, "Feasibility of Locomotive-Mounted Broken Rail Detection: Final Report for High-Speed Rail IDEA Project 38," IDEA Innovations Deserving Exploratory Analysis Programs, Transportation Research Board of the National Academies, Jun. 2004, pp. 1-31.

* cited by examiner

BROKEN RAIL DETECTION SYSTEM FOR RAILWAY SYSTEMS

BACKGROUND OF THE INVENTION

Field of the Invention

The present invention relates generally to railway networks and control systems used in connection with operating trains in the railway network, and in particular to systems and methods for detecting broken rails in the tracks, especially in railway systems, such as railway systems that implement communications-based train control systems and methods.

Description of Related Art

Conventional train signal systems use track circuits for two basic functions: train detection and broken rail detection. In addition, conventional alternating current (AC) coded track circuits are used for track-to-train communications of signal aspect data. The most common type of track circuit used in non-electrified lines is the direct current (DC) track circuit, which was invented in 1872 and is still widely used today. There are many variations to DC track circuits, including coding to extend lengths and transfer signal information between trackside locations via rails. These variations to DC track circuits use insulated joints to isolate adjacent track circuits, and are typically applied to define signal block sections, which are related to signal locations and fixed block train control systems. The signal block sections are used to maintain a safe separation distance between trains.

Audio frequency (AF) track circuits are commonly used in metro signal applications, where shorter headways are required to support trains with shorter stopping distances. AF track circuits are also applied to electrified lines where DC track circuits do not work. AF track circuits do not require insulated joints, but are limited in length due to rail inductance. More specifically, rail inductance typically limits lengths of AF track circuits to about 1 km, as compared to about a 5 km length limit for DC track circuits. Moreover, AF track circuits are more complex and expensive to build and operate than DC track circuits. The combination of increased cost and length limitations render AF track circuits economically impractical for application to lines designed for non-electrified freight traffic.

Communications Based Train Control (CBTC) systems are based upon trains determining and reporting their locations to a control office via radio data communications. A train may also be equipped to monitor its integrity, e.g., to ensure that the train remains connected together as a single unit with a location of each end of the train being known and reported to the control office. CBTC systems may be applied as a moving block configuration, which maintains safe separation distances between trains based upon communications between each of the trains and an office dispatch system. Train separation distances may thus be reduced by the "moving block" configuration based upon train speeds and braking capabilities. When the "moving block" configuration is combined with newer train braking systems, e.g., electrically-controlled pneumatic (ECP) brakes, braking distances can be further reduced. Safer operation of trains with smaller separation distances therebetween, as well as removal of fixed block and associated wayside signals, can accordingly be supported by CBTC systems.

Conventional CBTC systems can eliminate the need for block track circuits for train detection and associated safe train separation distance functions, but they do not address how to detect broken rail conditions. Conventional track circuits may therefore be applied in addition to the CBTC systems to provide for broken rail protection. The basic configuration of a track circuit is two parallel rails in a series arrangement with an electrical signal transmitter and electrical signal receiver. The rail vehicle wheels and axle spanning the rails in a section of track provide an electrical shunt between the rails. The shunt path created by the railway car causes the transmitted signal to detect the presence of the train in the section of track. The detected presence is used to activate upstream wayside signals to command approaching trains to slow or stop prior to entering an occupied section. Further, certain traditional railroad signaling systems involving track circuits are being replaced in some applications by CBTC technology whereby train position, speed, and direction are communicated via continuous bi-directional communications between vehicles and wayside computers. Examples of CBTCs include the Electronic Train Management System (ETMS) of Wabtec Corporation. While CBTC technology does not require track circuits to detect trains, such circuits may be retained for broken rail protection.

Conventional track circuits come in many different types, but standard signal applications use "normally energized" circuits, which have a power source on one end (for example, a battery) and a receiver (for example, a relay-activated switch) on the other end. When the train shunts the track, it shorts out the circuit and the relay drops. In this manner, the continuous current through the relay coil holds the switch in position indicative of the track section not occupied. An alternate track circuit configuration is "normally de-energized." The power source and the receiver are at the same end of the section. Power is applied as a train approaches the section. The train shunt completes the circuit and energizes the relay to indicate train presence. This is inherently not "fail-safe," as failure of the battery or relay could cause the relay to drop. An advantage of the "normally de-energized" track circuit with transmitter and receiver at the same end is the ability to check the track circuit for breaks while the train is within the track section provided the transmit/receive end is ahead of the train. Still further, AC coded track circuits may provide on-board detection of rail breaks when the train is within the section. In this case, the transmitter is on the far side of the section from the receiver with the train approaching the transmitter and while receiving coded signals with pick-up coils ahead of the lead axle. This is considered the safest form of traditional automatic train protection due to the continuous communications of the signal aspect data as well as ability to reflect rail breaks directly ahead of the train within the section (track circuit).

Single track networks typically have passing sidings (or stations) spaced 25 to 30 kilometers apart. Within the sidings/stations, which are typically around 3 kilometers long, and as discussed, broken rail detection may be provided with conventional DC track circuits. Due to low traffic density, there may not be a need for closely following trains in the block sections between sidings/stations. On-board systems, e.g., ETMS, and office systems presently provide train location functions, which eliminates the need for conventional track circuits for the entire network.

Therefore, there is a need in the art for improved broken rail detection systems and methods. There is also a need in the art for long distance broken rail detection systems and methods. With specific reference to light traffic, single track rail networks, there is a need in the art for technology that may be used to support the remote operation of switch machines, without the expense and need for full wayside signal and track circuit system.

SUMMARY OF THE INVENTION

Generally, provided is an improved broken rail detection system and method for railway systems. Preferably, provided are a broken rail detection system and method for a railway system that are useful for longer distance blocks or track sections. Preferably, provided are a broken rail detection system and method that can operate using minimal power and communication systems and arrangements. Preferably, provided are a broken rail detection system and method that can be implemented using existing power and communication systems and technology, e.g., existing switch devices and arrangements. Preferably, provided are a broken rail detection system and method that are useful in connection with communications-based train control systems.

According to one preferred and non-limiting embodiment, provided is a broken rail detection system for a portion of a railway track having a first and second opposing rail, each supported by at least one railroad tie and ballast material. The system includes: at least one power module having: (1) a first electrical connection to the first rail and configured to apply a direct current voltage to the first rail; and (2) a second electrical connection to the second rail and configured to apply a direct current voltage to the second rail; at least one diode shunt arrangement positioned at a distance from the at least one power module; at least one measurement device configured to sense or measure current resulting from the application of the direct current voltage from the first electrical connection and the second electrical connection; and at least one controller in direct or indirect communication with the at least one power module and the at least one measurement device. The at least one controller is programmed, configured, or adapted to: (i) cause at least one application of a direct current voltage of a first polarity on the railway track through the first electrical connection and second electrical connection; (ii) determine the current resulting from the application step (i) using the at least one measurement device; (iii) cause at least one application of a direct current voltage of a second polarity on the railway track through the first electrical connection and the second electrical connection; (iv) determine the current resulting from the application step (iii) using the at least one measurement device; and (v) determine the presence or absence of a break in at least one of the first and second rail based at least partially on the current determined in steps (ii) and (iv).

In another preferred and non-limiting embodiment, provided is a broken rail detection system for a portion of a railway track having a first and second opposing rail, each supported by at least one railroad tie and ballast material. The system includes: a first power module positioned at a first end of the portion of the railway track and having: (1) a first electrical connection to the first rail and configured to apply a direct current voltage to the first rail; and (2) a second electrical connection to the second rail and configured to apply a direct current voltage to the second rail; a first diode shunt arrangement positioned at a distance from the first end of the portion of the railway track; a first measurement device configured to sense or measure current resulting from the application of the direct current voltage from the first electrical connection and the second electrical connection; a first controller in direct or indirect communication with the first power module and the first measurement device and programmed, configured, or adapted to: (i) cause at least one application of a direct current voltage of a first polarity on the railway track through the first electrical connection and second electrical connection; (ii) determine the current resulting from the application step (i) using the first measurement device; (iii) cause at least one application of a direct current voltage of a second polarity on the railway track through the first electrical connection and the second electrical connection; (iv) determine the current resulting from the application step (iii) using the first measurement device; and (v) determine the presence or absence of a break in at least one of the first and second rail in a first portion of the portion of the railway track based at least partially on the current determined in steps (ii) and (iv); a second power module positioned at a second end of the portion of the railway track and having: (1) a first electrical connection to the first rail and configured to apply a direct current voltage to the first rail; and (2) a second electrical connection to the second rail and configured to apply a direct current voltage to the second rail; a second diode shunt arrangement positioned at a distance from the second end of the portion of the railway track; a second measurement device configured to sense or measure current resulting from the application of the direct current voltage from the first electrical connection and the second electrical connection; a second controller in direct or indirect communication with the second power module and the second measurement device and configured to: (i) cause at least one application of a direct current voltage of a first polarity on the railway track through the first electrical connection and second electrical connection; (ii) determine the current resulting from the application step (i) using the second measurement device; (iii) cause at least one application of a direct current voltage of a second polarity on the railway track through the first electrical connection and the second electrical connection; (iv) determine the current resulting from the application step (iii) using the second measurement device; and (v) determine the presence or absence of a break in at least one of the first and second rail in a second portion of the portion of the railway track based at least partially on the current determined in steps (ii) and (iv); and at least one insulation joint positioned between the first diode shunt and the second diode shunt and configured to prevent electrical communication between the first and second portions of the portion of the railway track.

In a further preferred and non-limiting embodiment, provided is a method for detecting a broken rail in a portion of a railway track having a first and second opposing rail, each supported by at least one railroad tie and ballast material. The method includes: (i) causing at least one application of a direct current voltage of a first polarity on the railway track through a first electrical connection to the first rail and a second electrical connection to the second rail; (ii) determining the current resulting from the application step (i); (iii) causing at least one application of a direct current voltage of a second polarity on the railway track through the first electrical connection and the second electrical connection; (iv) determining the current resulting from the application step (iii); and (v) determining the presence or absence of a break in at least one of the first and second rail based at least partially on the current determined in steps (ii) and (iv).

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
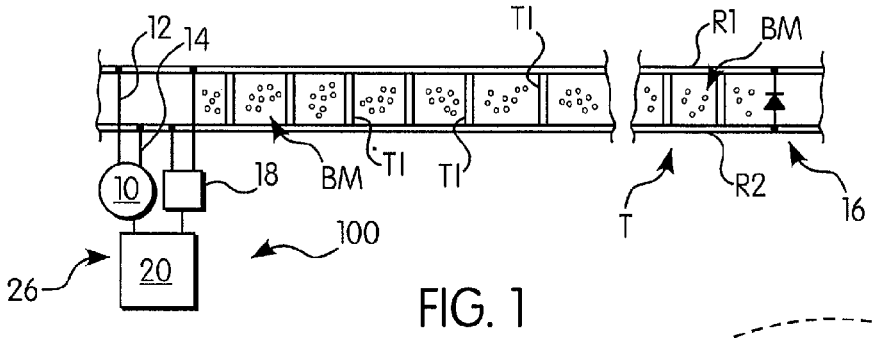
FIG. 1 is a schematic view of one embodiment of a broken rail detection system according to the principles of the present invention.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. It is to be understood that the invention may assume various alternative variations and step sequences, except where expressly specified to the contrary. It is also to be understood that the specific systems, devices, and processes illustrated in the attached drawings, and described in the following specification, are simply exemplary embodiments of the invention. Hence, specific dimensions and other physical characteristics related to the embodiments disclosed herein are not to be considered as limiting.

As used herein, the terms "communication" and "communicate" refer to the receipt or transfer of one or more signals, messages, commands, or other type of data. For one unit or component to be in communication with another unit or component means that the one unit or component is able to directly or indirectly receive data from and/or transmit data to the other unit or component. This can refer to a direct or indirect connection that may be wired and/or wireless in nature. Additionally, two units or components may be in communication with each other even though the data transmitted may be modified, processed, routed, and the like, between the first and second unit or component. For example, a first unit may be in communication with a second unit even though the first unit passively receives data, and does not actively transmit data to the second unit. As another example, a first unit may be in communication with a second unit if an intermediary unit processes data from one unit and transmits processed data to the second unit. It will be appreciated that numerous other arrangements are possible.

In certain preferred and non-limiting embodiments, the broken rail detection system and method is used in connection or integrated with Communications Based Train Control (CBTC) systems, for example, CBTC systems provided by the Wabtec ETMS®. Such preferred and non-limiting embodiments utilize the CBTC systems' knowledge of locations or positions of the trains in the track network.

In one preferred and non-limiting embodiment, and as illustrated in FIG. 1, provided is a broken rail detection system 100 for a portion of a railway track (T) having a first and second opposing rail (R1, R2), each supported by at least one railroad tie (TI) and ballast material (BM). As is known, the track (T) is constructed from materials suitable to support a train (TR) thereon, which typically includes multiple, spaced railroad ties (TI) supporting the rails (R1, R2). In order to support the ties (TI) and provide appropriate drainage, the ties (TI) are positioned on ballast material (BM), such as gravel, stone, rocks, sand, earth material, and the like.

With continued reference to the embodiment of FIG. 1, the system 100 includes at least one power module 10, which has a first electrical connection 12 to the first rail (R1) and is programmed, adapted, or configured to apply a direct current voltage to the first rail (R1) and a second electrical connection 14 to the second rail (R2) and is programmed, configured, or adapted to apply a direct current voltage to the second rail (R2). The system 100 further includes at least one diode shunt arrangement 16 positioned at a distance from the at least one power module 10. At least one measurement device 18 is provided and programmed, configured, or adapted to sense or measure the current resulting from the application of the direct current voltage from the first electrical connection 12 and the second electrical connection 14.

In addition, at least one controller 20 (e.g., a computer, an on-board controller of the train (TR), a train management computer of the train (TR), a remote server, central dispatch, a central controller, a wayside interface unit, a programmable switch device or arrangement, and/or any suitable computing device, whether locally positioned or remotely positioned) is in direct or indirect communication with the at least one power module 10 and the at least one measurement device 18, and the at least one controller 20 is programmed, configured, or adapted to: (i) cause at least one application of a direct current voltage of a first polarity on the railway track (T) through the first electrical connection 12 and second electrical connection 14; (ii) determine the current resulting from the application step (i) using the at least one measurement device 18; (iii) cause at least one application of a direct current voltage of a second polarity on the railway track (T) through the first electrical connection 12 and the second electrical connection 14; (iv) determine the current resulting from the application step (iii) using the at least one measurement device 18; and (v) determine the presence or absence of a break in at least one of the first rail (R1) and second rail (R2) based at least partially on the current determined in steps (ii) and (iv). In one preferred and non-limiting embodiment, the at least one controller 20 is positioned locally, i.e., at or near the at least one power module 10 and the at least one measurement device 18, and programmed, configured, or adapted to perform some or all of steps (i)-(v), such as (in one preferred and non-limiting embodiment) steps (i)-(iv). Accordingly, the determination step (v) may occur locally or remotely by the at least one controller 20, or some other computer in the system (as discussed above)

As discussed above, the presently-claimed system 100 has particular application in connection with detecting broken rails in larger sections of track (TR). Accordingly, and in another preferred and non-limiting embodiment, the distance between the at least one power module 10 and the at least one diode shunt arrangement 16 is up to about 20 kilometers. In another preferred and non-limiting embodiment, the at least one power module 10, the at least one measurement device 18, and/or the at least one controller 20, or any combination thereof, is integrated with or part of at least one existing electrically-powered railway device. For example, the existing electrically-powered railway device is may be a switch device or arrangement, a radio device, a wayside device, and/or a wayside interface unit, or any combination thereof. By integrating some or all of the components of the system 100 with an existing electrically-powered railway device, new electrical installations and units will not be required. This leads to a decrease in installation and maintenance costs, as well as overall system and communication complexity and operation.

In a further preferred and non-limiting embodiment, the voltage of the direct current applied in at least one of the application step (i) and application step (iii) includes or is in the form of a fixed voltage (e.g., a programmed and substantially constant voltage), a configurable voltage (e.g., a user-configurable voltage, which may be programmed or controlled through the at least one controller 20), an adjustable voltage (e.g., a voltage that is dynamically and/or manually adjustable (or selectable) based upon the application and environment), and/or a voltage pulse (e.g., a voltage pulse of a programmed, configurable, adjustable, fixed, and/or dynamic width and/or pattern), or any combination thereof. For example, and in one preferred and non-limiting embodiment, the voltage of the direct current is in the range of about 3 volts to about 12 volts.

In a further preferred and non-limiting embodiment, least one of the application step (i) and application step (iii) includes applying at least one pulse of direct current. In another preferred and non-limiting embodiment, this at least one pulse of direct current includes or is in the form of: a fixed voltage, a configurable voltage, an adjustable voltage, a fixed polarity (e.g., a programmed and specified polarity), a configurable polarity (e.g., a user-configurable polarity, which may be programmed or controlled through the at least one controller 20), an adjustable polarity (e.g., a polarity that is dynamically and/or manually adjustable (or selectable) based upon the application and environment), a fixed pulse width (e.g., a programmed and specified pulse width), a configurable pulse width (e.g., a user-configurable pulse width, which may be programmed or controlled through the at least one controller 20), an adjustable pulse width (e.g., a pulse width that is dynamically and/or manually adjustable (or selectable) based upon the application and environment), a fixed timing pattern (e.g., a programmed and specified timing pattern), a configurable timing pattern (e.g., a user-configurable timing pattern, which may be programmed or controlled through the at least one controller 20), an adjustable timing pattern (e.g., a timing pattern that is dynamically and/or manually adjustable (or selectable) based upon the application and environment), a fixed time period (e.g., a programmed and specified time period between two pulses or groups of pulses), a configurable time period (e.g., a user-configurable time period between two pulses or groups of pulses, which may be programmed or controlled through the at least one controller 20), an adjustable time period (e.g., a time period between two pulses or groups of pulses that is dynamically and/or manually adjustable (or selectable) based upon the application and environment), a fixed number of pulses (e.g., a programmed and specified number of pulses in a group or set of pulses), a configurable number of pulses (e.g., a user-configurable number of pulses in a group or set of pulses, which may be programmed or controlled through the at least one controller 20), and/or an adjustable number of pulses (e.g., a number of pulses in a group or set of pulses that is dynamically and/or manually adjustable (or selectable) based upon the application and environment), or any combination thereof.

In another preferred and non-limiting embodiment, the at least one pulse of direct current includes or is in the form of multiple pulses of direct current with opposite polarity between at least two of the plurality of pulses of direct current. In one exemplary embodiment, the at least one pulse of direct current includes or is in the form of multiple pulses of direct current with a pulse width in the range of about 80 milliseconds to about 120 milliseconds. In another exemplary embodiment, the at least one pulse of direct current includes or is in the form of multiple pulses of direct current with timing pattern between pulses of direct current in the range of about 200 milliseconds to about 300 milliseconds. In yet another exemplary embodiment, the at least one pulse of direct current includes or is in the form of multiple pulses of direct current that are pulsed over a time period in the range of about 5 seconds to about 20 seconds.

In one preferred and non-limiting embodiment, the voltage of the direct current of the first polarity and the voltage of the direct current of the second polarity are substantially identical. In another preferred and non-limiting embodiment, the voltage of the direct current of the first polarity and the voltage of the direct current of the second polarity are programmed, configured, or set based at least partially upon at least one of the following: (i) the distance between the at least one power module 10 and the at least one diode shunt arrangement 16; (ii) a condition of the ballast material (BM) (e.g., wet conditions, dry conditions, low temperature conditions, high temperature conditions, type of ballast material (BM), and/or the like) and/or; (iii) a condition of the railway track (T) or the ties (TI) (e.g., wet conditions, dry conditions, low temperature conditions, high temperature conditions, type or age of track (T) or the ties (TI), and/or the like; (iv) an environmental condition (rain, snow, dry, low temperature, high temperature, and/or the like), or any combination thereof.

In a further preferred and non-limiting embodiment, the at least one measurement device 18 includes or is in the form of at least one resistor and/or at least one current sensor. In particular, the at least one measurement device 18 is programmed, configured, or adapted to sense or measure the current after application of a voltage by the at least one power module 10 through the first electrical connection 12 and/or the second electrical connection 14. In another preferred and non-limiting embodiment, prior to application step (i), the at least one controller 20 is further programmed, configured, or adapted to determine whether the railway track (T) between the at least one power module 10 and the at least one diode shunt arrangement 16 is occupied by at least one railcar. For example, and by using the at least one measurement device 18 and/or some other current-sensing device, or through data or information obtained by the at least one controller 20 from some other computer or computing system (e.g., a computer, an on-board controller of the train (TR), a train management computer of the train (TR), a remote server, central dispatch, a central controller, a wayside interface unit, a programmable switch device or arrangement, and/or any suitable computing device, whether locally positioned or remotely positioned), a determination can be made as to whether the section or portion of track (T) is occupied by a train (TR), railcar, etc. If it is determined that the section or portion of the track (T) is occupied, then the at least one controller 20 prevents the voltage application and resulting break determination method described above until such time as the section or portion of track (T) is unoccupied.

Figure 2:
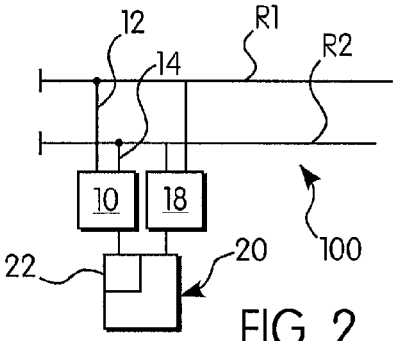
FIG. 2 is a schematic view of another embodiment of a broken rail detection system according to the principles of the present invention.

In another preferred and non-limiting embodiment, and as illustrated in schematic form in FIG. 2, the system 100 includes at least one communication device programmed, configured, or adapted to directly or indirectly transmit system data to at least one remote computer (e.g., a computer, an on-board controller of the train (TR), a train management computer of the train (TR), a remote server, central dispatch, a central controller, a wayside interface unit, a programmable switch device or arrangement, and/or any suitable computing device). This system data, which may include any of the data (whether raw or processed data) that is used, obtained, and/or determined by the at least one controller 20, may then be used in making certain other train control operational and traffic control decisions. For example, any of this data (and/or the determinations made by the at least one controller 20 (e.g., a break in the rail (R1, R2) exists) can be used by central dispatch and/or trains (TR) that are travelling towards or within the portion of section of track (T) for re-routing, braking, and/or other preventative measures or alarm-based operations.

Figure 3:
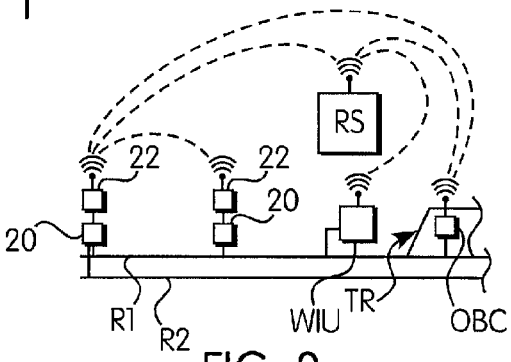
FIG. 3 is a schematic view of a further embodiment of a broken rail detection system according to the principles of the present invention.

With reference to FIG. 3, and in another preferred and non-limiting embodiment, the at least one communication device 22 can be programmed, configured, or adapted to directly or indirectly communicate over the rails (R1, R2) to some other computer or system (e.g., an on-board controller (OBC) of a train (TR), a wayside interface unit (WIU), another controller 20, and/or the like). In addition, the at least one communication device can be programmed, configured, or adapted to directly or indirectly communicate wirelessly to some other computer or system (e.g., central dispatch (e.g., a remote server (RS)), an on-board controller (OBC) of a train (TR), a wayside interface unit (WIU), another controller 20, and/or the like). Further, and as discussed above, these other computers or systems may be part of, integrated with, or in communication with any of the components of the system 100 (or any component thereof), thereby allowing for the control and implementation of one or more of the steps (i)-(v) described above.

In a further preferred and non-limiting embodiment, the determination step (v) includes: (a) determining the difference between the current determined in step (ii) and the current determined in step (iv); and (b) determining the presence or absence of a break in the first rail (R1) or the second rail (R2) of the railway track (T) if the difference is less than a specified value or percentage. In another preferred and non-limiting embodiment, the determination step (b) includes determining the presence of a break in the first rail (R1) or the second rail (R2) of the railway track (T) if the measured current in determination step (ii) is substantially identical to the measured current in determination step (iv). Still further, and in another preferred and non-limiting embodiment, the determination step (v) is at least partially based upon: (i) the distance between the at least one power module 10 and the at least one diode shunt arrangement (16); (ii) a condition of the ballast material (BM); (iii) a condition of the railway track (T); and/or (iv) an environmental condition, or any combination thereof.

In a still further preferred and non-limiting embodiment, at least one of steps (i)-(v) (and, in one preferred and non-limiting embodiment, all of steps (i)-(v)) are implemented based upon receipt, by the at least one controller 20, of: (1) a command from at least one remote computer or remote server (RS); (2) a command from at least one remote computer or remote server (RS) prior to issuance of a movement authority to a specified train (TR); (3) a command from at least one remote computer or remote server (RS) to the specified train (TR) prior to entering the portion of the railway track (T); and/or (4) a command from at least one remote computer or remote server (RS) to the specified train (TR) after exiting the portion of the railway track (T), or any combination thereof. In another preferred and non-limiting embodiment, at least one of steps (i)-(v) (and, in one preferred and non-limiting embodiment, all of steps (i)-(v)) are implemented based upon: a specified schedule (e.g., at specific times of day, at specific intervals, and/or the like), a configurable schedule (e.g., a user-configurable or user-adjustable schedule), a specified time period (e.g., at specific time periods or intervals), a configurable time period (e.g., a user-configurable or user-adjustable time period), track data (e.g., track conditions), train data (e.g., train (TR) conditions), environment data (e.g., weather, temperature, surrounding environment, and/or the like), and/or condition data (e.g., based upon specific conditions or parameters), or any combination thereof. In yet another preferred and non-limiting embodiment, at least one of steps (i)-(v) (and, in one preferred and non-limiting embodiment, all of steps (i)-(v)) are implemented while a train (TR) is travelling towards the portion of the railway track (T).

Figure 4:
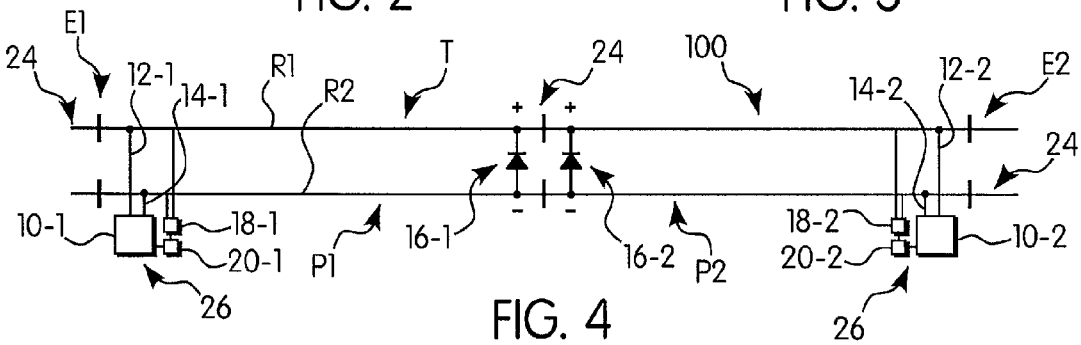
FIG. 4 is a schematic view of a further embodiment of a broken rail detection system according to the principles of the present invention.

In another preferred and non-limiting embodiment, and as illustrated in FIG. 4, the broken rail detection system 100 is used in connection with a specified portion of a railway track (T). The system includes: a first power module 10-1 positioned at a first end (E1) of the portion of the railway track (T) and having: (1) a first electrical connection 12-1 to the first rail (R1) configured to apply a direct current voltage to the first rail (R1); and (2) a second electrical connection 14-1 to the second rail (R2) and configured to apply a direct current voltage to the second rail (R2); a first diode shunt arrangement 16-1 positioned at a distance from the first end (E1) of the portion of the railway track (T); a first measurement device 18-1 programmed, configured, or adapted to sense or measure current resulting from the application of the direct current voltage from the first electrical connection 12-1 and the second electrical connection 14-1; and a first controller 20-1 in direct or indirect communication with the first power module 10-1 and the first measurement device 18-1 and programmed, configured, or adapted to: (i) cause at least one application of a direct current voltage of a first polarity on the railway track (T) through the first electrical connection 12-1 and second electrical connection 14-1; (ii) determine the current resulting from the application step (i) using the first measurement device 18-1; (iii) cause at least one application of a direct current voltage of a second polarity on the railway track (T) through the first electrical connection 12-1 and the second electrical connection 14-1; (iv) determine the current resulting from the application step (iii) using the first measurement device 18-1; and (v) determine the presence or absence of a break in at least one of the first rail (R1) and second rail (R2) in a first portion (P1) of the portion of the railway track (T) based at least partially on the current determined in steps (ii) and (iv).

With continued reference to the embodiment of FIG. 4, the system 100 further includes: a second power module 10-2 positioned at a second end (E2) of the portion of the railway track and having: (1) a first electrical connection 12-2 to the first rail (R1) and configured to apply a direct current voltage to the first rail (R1); and (2) a second electrical connection 14-2 to the second rail (R2) and configured to apply a direct current voltage to the second rail (R2); a second diode shunt arrangement (16-2) positioned at a distance from the second end (E2) of the portion of the railway track (T); a second measurement device 18-2 programmed, configured, or adapted to sense or measure current resulting from the application of the direct current voltage from the first electrical connection 12-2 and the second electrical connection 14-2; and a second controller 20-2 in direct or indirect communication with the second power module 10-2 and the second measurement device 18-2 and programmed, configured, or adapted to: (i) cause at least one application of a direct current voltage of a first polarity on the railway track (T) through the first electrical connection 12-2 and second electrical connection 14-2; (ii) determine the current resulting from the application step (i) using the second measurement device 18-2; (iii) cause at least one application of a direct current voltage of a second polarity on the railway track (T) through the first electrical connection 12-2 and the second electrical connection 14-2; (iv) determine the current resulting from the application step (iii) using the second measurement device 18-2; and (v) determine the presence or absence of a break in at least one of the first rail (R1) and second rail (R2) in a second portion (P2) of the portion of the railway track (T) based at least partially on the current determined in steps (ii) and (iv). Further, at least one insulation joint 24 is positioned between the first diode shunt arrangement 16-1 and the second diode shunt arrangement 16-2 and configured to prevent electrical communication between the first portion (P1) and second portion (P2) of the portion of the railway track (T).

In a still further preferred and non-limiting embodiment, provided is a method for detecting a broken rail in a portion of a railway track (T) having a first and second opposing rails (R1, R2), each supported by at least one railroad tie (TI) and ballast material (BM). The method includes: (i) causing at least one application of a direct current voltage of a first polarity on the railway track (T) through a first electrical connection 12 to the first rail (R1) and a second electrical connection 14 to the second rail (R2); (ii) determining the current resulting from the application step (i); (iii) causing at least one application of a direct current voltage of a second polarity on the railway track (T) through the first electrical connection 12 and the second electrical connection 14; (iv) determining the current resulting from the application step (iii); and (v) determining the presence or absence of a break in at least one of the first rail (R1) and second rail (R2) based at least partially on the current determined in steps (ii) and (iv).

In one exemplary embodiment, and within each station or a portion of railway track (T), conventional direct current or coded direct current track circuits can be utilized within the spirit and context of the present invention. In one embodiment, the broken rail detection system 100 is particularly applicable for detecting broken rails (R1, R2) between stations 26, i.e., a structural location (optionally preexisting) that includes or integrates a power module 10/measurement device 18/controller 20 arrangement (as discussed above), with lengths up to or greater than 30 kilometers.

Accordingly, in one preferred and non-limiting embodiment, a key objective of the present invention, which relates to both initial and life-cycle costs, is to avoid the need to establish any new wayside installation sites (outside of the station areas) with active electronics, with the associated need for power. Accordingly, and as discussed above, depending upon the length of the portion of railway track (T) one or more power module 10/measurement device 18/controller 20 arrangements (or stations 26) can be used. For example, the use of one such station 26 is illustrated in FIG. 1, while the use of two such stations 26 is illustrated in FIG. 4. It is envisioned that the diode shunt arrangement 16 can be buried in the ballast material (BM), attached to a tie (TI), and/or mounted within a small pedestal, without the requirement of any external power. Further, and in one preferred and non-limiting embodiment, the track limits on the station ends may be defined by insulated joints 24 at the switch machine track circuits.

Figure 5:
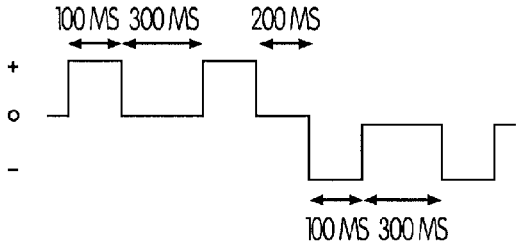
FIG. 5 is one embodiment of a direct current voltage application method for a broken rail detection system according to the principles of the present invention.

In another exemplary embodiment, the power module 10, the measurement device 18, and controller 20 together form or are part of the station 26, which, as discussed above, represent components that may be attached to, operational with, or integrated with an existing electrical device, such as a switch device or arrangement. In one preferred and non-limiting embodiment, each station 26 acts to apply a direct current voltage on the track (T) with a fixed pulse width, a fixed pattern of pulse timing, and alternating polarities of the pulse using the first electrical connection 12 and the second electrical connection 14. The voltage could be fixed, or adjustable on a site-selection basis (e.g., based upon length and ballast material (BM) conditions). In this exemplary embodiment, the voltage are in the range of about 3 to about 12 volts, and the pulse widths are about 100 milliseconds in width, with 200-300 milliseconds between pulses. These values are similar to existing DC-coded track systems, and have been established to obtain maximum track circuit length performance. The slow code rate minimizes the inductance effect of the rail (R1, R2). With continued reference to this exemplary embodiment, and as illustrated in schematic form in FIG. 5, an example pulse scheme for use in the method and system 100 includes two 100 millisecond positive polarity pulses, with 300 milliseconds between these pulses, and after another interval of 200 milliseconds, the application of two negative polarity pulses of 100 milliseconds in pulse width, with 300 milliseconds between pulses.

With continued reference to this preferred and non-limiting embodiment, the positive and negative voltages would be substantially identical, and are in the range of about 3 volts to about 10 volts. As discussed, this voltage could be configurable or adjustable, with respect to each application, and based at least partially upon the track circuit length and ballast material (BM) conditions, e.g., higher voltage for longer track circuits, and lower ballast material (BM) conditions. While, in this embodiment, the pulse pattern is relatively simple, it is envisioned that the pulse width and timing between pulses may be used as a validity check when measuring current, to identify any other power or noise inputs. In this embodiment, the station 26 (or specific components thereof) would be normally de-energized, and would only need to be on for about ten seconds to perform a check according to the presently-invented method, and as optionally requested from a remote computer or a remote server (RS). This would provide about twenty pulses in each polarity for current measurement, and comparisons between pulses, which would reduce the impact of intermittent noise conditions. It is noted that there are many variations to the potential pulse widths and patterns, which could be used to achieve the same measurement results.

In another preferred and non-limiting embodiment, the overall track circuit is configured in a series mode, with the ability to measure current at the same location as the transmitter. Accordingly, a resistor could be used for measuring voltage drop, or a current sensor could be used on the return line. As discussed, the measurement device 18 (together with the controller 20) is used to measure and/or determine the impedance of the total track circuit; optionally when the track is confirmed as empty based upon information and data regarding track occupancy, such as from central dispatch or the like. It is further envisioned that adjacent stations 26 could be coordinated, such as through command and controlled by central dispatch or some other remote server (RS), such that the method is only implemented at one end (E1, E2) at a time. This will avoid undesired measurements based upon power inserted from the adjacent station 26.

In another preferred and non-limiting embodiment, the controller 20 includes or is in the form of a microcontroller that controls the application of track pulses and measurement of current; optionally with data tests managed from central dispatch or some remote server (RS). The collected or determined data may also be transmitted to central dispatch or some remote computer or remote server (RS), as discussed above. In this embodiment, the determination of rail breaks will be made at central dispatch (or the remote computer or remote server (RS)), i.e., step (v), which can then reflect or transmit this data in creating and issuing movement authorities to the relevant trains (TR).

In another preferred and non-limiting embodiment, the system 100 will measure the total track impedance with both polarities. Normal measurements without rail breaks will show a difference in the impedance measurement between positive and negative polarities, which indicates that the circuit has reached the track diode shunt arrangement 16, i.e., from the first electrical connection 12 to the second electrical connection 14 through the diode shunt arrangement 16. In one polarity, a very low resistance, e.g., about 0.5 ohm, will be sensed or determined, and in the opposite polarity, a heightened impedance will be sensed or determined, which, in practice, will be substantially equivalent to the conditions of the ballast material (BM). Accordingly, the system 10 compensates for variable ballast material (BM) conditions. In this embodiment, if there is a broken rail (R1, R2) within the circuit, before the location of the diode shunt arrangement 16, the impedance measurement will be the same in both the positive and negative polarities.

portion of railway track (T)) to be monitored operates in the illustrated electrical network, where R is the welded rail resistance for continuously-welded track (which may be about 0.035 ohms/km). It is further noted that inductance has minimal impact for direct current or low-frequency alternating (e.g. 100 millisecond pulse width) voltages. In addition, and with continued reference to FIG. 6, B represents ballast material (BM) resistance, which is typically in the range of about 2 ohms/km to about 10 ohms/km, with a potential of going as low as 1 ohm under heavy rain conditions. There is also a capacitance factor between the rails, but this factor is negligible for direct current and low-frequency alternating current track circuits. Voltage is applied with current measured on the opposite end as the diode shunt arrangement 16 in order to determine the impedance (I) of the total circuit.

The diode resistance (D) will vary by type selected and voltage across the diode, but may be approximated as 0.5 ohms in the forward direction in one embodiment. In the reverse direction, the diode resistance (D) will be very high, with the overall effective resistance being close to the same as the ballast resistance (B). In conditions without a broken rail, the main variables are the ballast resistance (B), which will change between dry and wet (rain) conditions. The ballast resistance (B) will not necessarily be uniform over a 15 kilometer length, for a variety of reasons. However, it is clear that the ballast resistance (R) will average substantially the same value, independent of the polarity of the measurement voltage, up to the location of the diode shunt arrangement 16. Accordingly, in this embodiment, a key requirement is the ability to sense the diode shunt arrangement 16, e.g., positioned 15 kilometers or more away from the voltage application, based upon comparing the overall circuit impedance (I) differences between the voltage polarities.

In one exemplary embodiment, and as illustrated in Table 1 below, the impedance calculated with different ballast conditions provides the following calculated values, as seen at the source voltage end, for each polarity.

TABLE 1

| Current | Impedance Values with Different Ballast Resistances/Km | | | | | |
|---|---|---|---|---|---|---|
| Direction | 1 Ohm | 2 Ohms | 4 Ohms | 6 Ohms | 8 Ohms | 10 Ohms |
| Positive | 0.301991 | 0.411503 | 0.565422 | 0.677964 | 0.766145 | 0.837651 |
| Negative | 0.30217 | 0.41415 | 0.585798 | 0.731343 | 0.863161 | 0.985175 |
| Difference | 0.0593% | 0.6392% | 3.4783% | 7.2987% | 11.2395% | 14.9744% |

It is noted that conventional direct current coded track circuits applied to continuously welded rails are effectively limited to around six kilometers. This limitation is based at least partially upon the need to provide vital shunt and broken rail detection within a wide range of ballast material conditions. According to the present invention, and in one preferred and non-limiting embodiment, there is no need for shunt detection, and testing and checking the circuit or portion of railway track (T) can be implemented when the portion of track (T) is not occupied. Accordingly, the measurement of impedance in both polarities, with a diode shunt arrangement 16 defining the outer circuit, allows for the effective compensation for changes in ballast resistance. Accordingly, and in this embodiment, the system 100 allows for broken rail detection over much greater distances, e.g, about 15 kilometers or longer, with a wide range of ballast material (BM) types and ballast material (BM) conditions.

Figure 6:
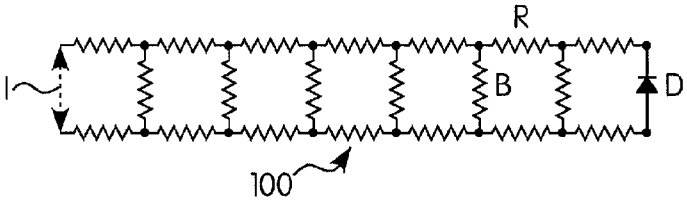
FIG. 6 is one embodiment of an electrical diagram for a broken rail detection system according to the principles of the present invention.

In another preferred and non-limiting embodiment, and as illustrated in schematic form in FIG. 6, the track circuit (or It should be noted that higher ballast material (BM) conditions lead to easier detection of the track circuit impedance between positive and negative voltage applications, and the difference reduces with a drop of ballast resistance (R). However, even with the lowest ballast resistance (R) assumption, e.g., 1 ohm/km, there is a measurable difference that should be in the range of reliable detectability using conventional measurement techniques. In this preferred and non-limiting embodiment, it should be further noted that the absolute impedance or current measurement is not as important as the comparison between the positive and negative sequential direct current pulses. Multiple cycles of the positive and negative pulse streams can be measured to increase detectability of small differences, as reflected by worse-case low ballast material (BM) conditions In another preferred and non-limiting embodiment, any rail break will effectively take the diode shunt arrangement 16 out of the circuit, leading to the positive and negative impedance measurements being substantially identical. For any given installation, and with known track length and range of ballast material (BM) conditions, it is possible for the system 100 to "learn" the normal variations in ballast material (BM). In high ballast material (BM) conditions, this results in determining a greater distance between the positive and negative readings to indicate a normal, i.e., non-broken rail, condition. This "learning" can be used to increase accuracy and minimize false positive alarms, and may also be useful in application to other stations 26 or systems 100 implemented in other track portions in the track network having similar distances and ballast material (BM) conditions.

In a further preferred and non-limiting embodiment, the station 26 (or some component thereof) is normally de-energized, with the test or "check" mode controlled by central dispatch or some remote server (RS), and based upon train movement. It is envisioned that the average power demand of the system 100 is relatively low. In addition, it is further envisioned that the measurements and determinations discussed above can be made or implemented based upon certain train movement conditions. In one preferred and non-limiting embodiment, these train movement conditions are as follows: (1) prior to central dispatch issuing a movement authority into the block, a check could be made to verify that each non-occupied track section in the blocks covering the intended authority do not show any broken rails; (2) after central dispatch issues the movement authority, and just before the train (TR) enters the track circuit (if more than a few minutes after the movement authority is issued), a check could be made again, to make a ballast material (BM) measurement. If this check shows a broken rail condition (which is an unusual condition, if previously clear, with no other train movements), the central dispatch (and/or the controller 20) can send an alarm to the train (TR) (and this could also be in terms of a speed restriction tied to the movement over the broken rail of the track section); and (3) after the train (TR) completes the movement and exits the circuit, another check may be made to see if a rail break occurred under the train (TR), where if the check indicates a broken rail, it will also measure the new effective impedance of the circuit to provide an estimated location of the rail break location, and use the previous check as the estimate of a full track (i.e., non-broken rail) impedance as the calibration point to estimate the break location.

In another preferred and non-limiting embodiment, a track maintenance mode could also be provided to work interactively with Hy-Rail vehicles (with rail wheel shunts), or restricted speed locomotives or trains, to assist in locating rail break locations with higher accuracy. In this embodiment, frequent impedance measurements (on the order of about each five seconds) could be made while the vehicle is moving over the circuit. When the break location is passed, there will be a step function change in the impedance measurement, which can be compared with the vehicle location.

In this manner, the present invention provides an improved broken rail detection system and method for railway systems, including, but not limited to CBTC systems and applications. The presently-invented system and method is particularly applicable and useful in connection with long broken rail detection track circuits, with power and active electronics only required at one end of the circuit. This facilitates single track block sections of great distance, e.g., 30 kilometers or greater, between switch locations to be monitored from the same equipment locations used for switch control. In addition, the use of the diode shunt arrangement 16 combined with dual polarity coded direct current pulses, provides the ability to automatically compensate for wide changes in ballast resistance, to support maximum length detection. Still further, measurement of the track impedance after a rail break occurs, compared to the last measurement before the break event, provides an effective method to estimate the location of the break within the circuit. In addition, and in one embodiment, integration with a CBTC system provides logic to make measurements when the track circuits are known to be not occupied, and also provides the ability to improve precision location of rail breaks by measuring impedance changes while a train or maintenance vehicle is moving over the circuit. Also, the presently-invented system and method are useful in connection with light traffic applications, with one benefit of co-locating electronics and power needs with the switch device or arrangement locations (as well as supporting broken rail detection for long track sections between switch devices and arrangements, without the need to utilize separate electronics, housings, or power between them.) Still further, the above-described system and method can be effectively implemented in non-signal territory under appropriate Track Warrant Control (TWC) procedures.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A broken rail detection system for a portion of a railway track having a first and second opposing rail, each supported by at least one railroad tie and ballast material, the system comprising:

a power module positioned at a first end of the portion of the railway track, the power module comprising: (1) a first electrical connection to the first rail and configured to apply a direct current voltage to the first rail; and (2) a second electrical connection to the second rail and configured to apply a direct current voltage to the second rail;

a at least one diode shunt arrangement positioned at a distance from the at least one power module;

at least one measurement device configured to sense or measure current resulting from the application of the direct current voltage from the first electrical connection and the second electrical connection; and at least one controller in direct or indirect communication with the at least one power module and the at least one measurement device and programmed or configured to:

(i) cause at least one application of a direct current voltage of a first polarity on the railway track through the first electrical connection and second electrical connection;

(ii) determine the current resulting from the application step (i) using the at least one measurement device;

(iii) cause at least one application of a direct current voltage of a second polarity on the railway track through the first electrical connection and the second electrical connection;

(iv) determine the current resulting from the application step (iii) using the at least one measurement device; and (v) determine the presence or absence of a break in at least one of the first and second rail based at least partially on the current determined in steps (ii) and (iv).

2. The system of claim 1, wherein the distance between the at least one power module and the at least one diode shunt arrangement is up to about 20 kilometers.

3. The system of claim 1, wherein at least one of the following: the at least one power module, the at least one measurement device, the at least one controller, or any combination thereof, is integrated with or part of at least one existing electrically-powered railway device.

4. The system of claim 3, wherein the at least one existing electrically-powered railway device is at least one of the following: a switch device or arrangement, a radio device, a wayside device, a wayside interface unit, or any combination thereof.

5. The system of claim 1, wherein the voltage of the direct current applied in at least one of the application step (i) and application step (iii) comprises at least one of the following: a fixed voltage, a configurable voltage, an adjustable voltage, a voltage pulse, or any combination thereof.

6. The system of claim 5, wherein the voltage of the direct current is in the range of about 3 volts to about 12 volts.

7. The system of claim 1, wherein at least one of the application step (i) and application step (iii) comprises applying at least one pulse of direct current.

8. The system of claim 7, wherein the at least one pulse of direct current comprises at least one of the following: a fixed voltage, a configurable voltage, an adjustable voltage, a fixed polarity, a configurable polarity, an adjustable polarity, a fixed pulse width, a configurable pulse width, an adjustable pulse width, a fixed timing pattern, a configurable timing pattern, an adjustable timing pattern, a fixed time period, a configurable time period, an adjustable time period, a fixed number of pulses, a configurable number of pulses, an adjustable number of pulses, or any combination thereof.

9. The system of claim 8, wherein the at least one pulse of direct current comprises a plurality of pulses of direct current with opposite polarity between at least two of the plurality of pulses of direct current.

10. The system of claim 8, wherein the at least one pulse of direct current comprises a plurality of pulses of direct current with a pulse width in the range of about 80 milliseconds to about 120 milliseconds.

11. The system of claim 8, wherein the at least one pulse of direct current comprises a plurality of pulses of direct current with timing pattern between pulses of direct current in the range of about 200 milliseconds to about 300 milliseconds.

12. The system of claim 8, wherein the at least one pulse of direct current comprises a plurality of pulses of direct current that are pulsed over a time period in the range of about 5 seconds to about 20 seconds.

13. The system of claim 1, wherein the voltage of the direct current of the first polarity and the voltage of the direct current of the second polarity are substantially identical.

14. The system of claim 1, wherein the voltage of the direct current of the first polarity and the voltage of the direct current of the second polarity are configured based at least partially upon at least one of the following: (i) the distance between the at least one power module and the at least one diode shunt arrangement; (ii) a condition of the ballast material; (iii) a condition of the railway track; (iv) an environmental condition, or any combination thereof.

15. The system of claim 1, wherein the at least one measurement device is at least one of the following: at least one resistor, at least one current sensor, or any combination thereof.

16. The system of claim 1, wherein, prior to application step (i), the at least one controller is further programmed or configured to determine whether the railway track between the at least one power module and the at least one diode shunt arrangement is occupied by at least one railcar.

17. The system of claim 1, further comprising at least one communication device programmed or configured to directly or indirectly transmit system data to at least one remote computer.

18. The system of claim 1, wherein the determination step (v) comprises:

(a) determining the difference between the current determined in step (ii) and the current determined in step (iv); and (b) determining the presence or absence of a break in the first rail or the second rail of the railway track if the difference is less than a specified value or percentage.

19. The system of claim 18, wherein the determination step (b) comprises determining the presence of a break in the first rail or the second rail of the railway track if the measured current in determination step (ii) is substantially identical to the measured current in determination step (iv).

20. The system of claim 1, wherein the determination step (v) is at least partially based upon at least one of the following: (i) the distance between the at least one power module and the at least one diode shunt arrangement; (ii) a condition of the ballast material; (iii) a condition of the railway track; (iv) an environmental condition, or any combination thereof.

21. The system of claim 1, wherein at least one of steps (i)-(v) are implemented based upon receipt, by the at least one controller, of at least one of the following: (1) a command from at least one remote computer; (2) a command from at least one remote computer prior to issuance of a movement authority to a specified train; (3) a command from at least one remote computer to the specified train prior to entering the portion of the railway track; (4) a command from at least one remote computer to the specified train after exiting the portion of the railway track, or any combination thereof.

22. The system of claim 1, wherein at least one of steps (i)-(v) are implemented based upon at least one of the following: a specified schedule, a configurable schedule, a specified time period, a configurable time period, track data, train data, environment data, condition data, or any combination thereof.

23. The system of claim 1, wherein at least one of steps (i)-(v) are implemented while a train is travelling towards or within the portion of the railway track.

24. A broken rail detection system for a portion of a railway track having a first and second opposing rail, each supported by at least one railroad tie and ballast material, the system comprising:

a first power module positioned at a first end of the portion of the railway track and having: (1) a first electrical connection to the first rail and configured to apply a direct current voltage to the first rail; and (2) a second electrical connection to the second rail and configured to apply a direct current voltage to the second rail;

a first diode shunt arrangement positioned at a distance from the first end of the portion of the railway track;

a first measurement device configured to sense or measure current resulting from the application of the direct current voltage from the first electrical connection and the second electrical connection;

a first controller in direct or indirect communication with the first power module and the first measurement device and programmed or configured to: (i) cause at least one application of a direct current voltage of a first polarity on the railway track through the first electrical connection and second electrical connection; (ii) determine the current resulting from the application step (i) using the first measurement device; (iii) cause at least one application of a direct current voltage of a second polarity on the railway track through the first electrical connection and the second electrical connection; (iv) determine the current resulting from the application step (iii) using the first measurement device; and (v) determine the presence or absence of a break in at least one of the first and second rail in a first portion of the portion of the railway track based at least partially on the current determined in steps (ii) and (iv);

a second power module positioned at a second end of the portion of the railway track and having: (1) a first electrical connection to the first rail and configured to apply a direct current voltage to the first rail; and (2) a second electrical connection to the second rail and configured to apply a direct current voltage to the second rail;

a second diode shunt arrangement positioned at a distance from the second end of the portion of the railway track;

a second measurement device configured to sense or measure current resulting from the application of the direct current voltage from the first electrical connection and the second electrical connection;

a second controller in direct or indirect communication with the second power module and the second measurement device and programmed or configured to: (i) cause at least one application of a direct current voltage of a first polarity on the railway track through the first electrical connection and second electrical connection; (ii) determine the current resulting from the application step (i) using the second measurement device; (iii) cause at least one application of a direct current voltage of a second polarity on the railway track through the first electrical connection and the second electrical connection; (iv) determine the current resulting from the application step (iii) using the second measurement device; and (v) determine the presence or absence of a break in at least one of the first and second rail in a second portion of the portion of the railway track based at least partially on the current determined in steps (ii) and (iv); and at least one insulation joint positioned between the first diode shunt arrangement and the second diode shunt arrangement and configured to prevent electrical communication between the first and second portions of the portion of the railway track.

25. A method for detecting a broken rail in a portion of a railway track having a first and second opposing rail, each supported by at least one railroad tie and ballast material, the method comprising:

(i) causing at least one application of a direct current voltage of a first polarity on the railway track through a first electrical connection to the first rail and a second electrical connection to the second rail;

(ii) determining the current resulting from the application step (i);

(iii) causing at least one application of a direct current voltage of a second polarity on the railway track through the first electrical connection and the second electrical connection;

(iv) determining the current resulting from the application step (iii); and (v) determining the presence or absence of a break in at least one of the first and second rail based at least partially on the current determined in steps (ii) and (iv).

* * * * *